United States Patent [19]

Knepper et al.

[11] Patent Number: 4,595,523

[45] Date of Patent: Jun. 17, 1986

[54] CORROSION INHIBITION IN ENGINE FUEL SYSTEMS

[75] Inventors: J. Irvine Knepper; Robert J. Garrecht; George W. Dear, all of St. Louis, Mo.

[73] Assignee: Petrolite Corporation, St. Louis, Mo.

[21] Appl. No.: 510,011

[22] Filed: Jul. 1, 1983

[51] Int. Cl.[4] ..... C09K 3/00

[52] U.S. Cl. ..... 252/390; 252/392; 106/14.31

[58] Field of Search ..... 252/390, 392; 106/14.05, 14.31; 44/56

[56] References Cited

U.S. PATENT DOCUMENTS

| | | | |
|---|---|---|---|
| 2,460,259 | 1/1949 | Kahler | 252/390 |
| 2,956,889 | 10/1960 | Denman | 252/392 |
| 3,531,414 | 9/1970 | Randell et al. | 252/392 |
| 3,791,803 | 2/1974 | Andress, Jr. et al. | 252/392 |
| 3,985,503 | 10/1976 | O'Neal, Jr. | 252/392 |
| 4,131,583 | 12/1978 | Boerwinkle | 252/392 |
| 4,219,433 | 8/1980 | Manabe et al. | 252/392 |
| 4,235,838 | 11/1980 | Redmore et al. | 252/392 |
| 4,253,876 | 3/1981 | Godar et al. | 106/14.31 |
| 4,294,585 | 10/1981 | Sung | 44/56 |
| 4,317,744 | 3/1982 | Levi | 106/14.05 |
| 4,326,987 | 4/1982 | Hendricks et al. | 106/14.31 |
| 4,376,635 | 3/1983 | Sung | 252/392 |
| 4,406,811 | 9/1983 | Christensen et al. | 252/392 |
| 4,422,953 | 12/1983 | Grace et al. | 252/392 |
| 4,445,907 | 5/1984 | Sung | 252/392 |

*Primary Examiner*—Paul Lieberman
*Assistant Examiner*—Willie J. Thompson
*Attorney, Agent, or Firm*—Robert E. Wexler

[57] ABSTRACT

There is provided a corrosion inhibitor for use in the storage, distribution and use of alcohol as a fuel for internal combustion engines. The inhibitor comprises a triazole and an amine salt of an acid. There is further provided a corrosion-inhibited alcohol fuel and a method of inhibiting corrosion in metals.

23 Claims, No Drawings

CORROSION INHIBITION IN ENGINE FUEL SYSTEMS

BACKGROUND OF THE INVENTION

1. Field of the Invention

This invention relates to the field of corrosion inhibition. More particularly, the invention relates to the inhibition of corrosion of metals commonly used in the fuel distribution and handling systems for internal combustion engines, especially where the fuel is alcohol and the engine is used to power motor vehicles.

Alcohols have, in the past, been used as extenders and replacements for petroleum fuels in internal combustion engines. Thus, "gasohol" fuel is becoming increasing familar as an engine fuel in the United States. If oil supplies become less available in future years, it is anticipated that alcohols may gradually replace petroleum fuels in internal combustion engines. In Brazil, for example, ethanol is widely used as fuel for internal combustion engines. In the United States, both methanol and ethanol have been considered for supplementation or replacement of petroleum fuels.

The use of alcohols, such as ethanol, as a replacement fuel for petroleum in internal combustion engines presents corrosion problems not heretofore encountered in petroleum fueled internal combustion engines. Thus, alcohol fuels present corrosion problems throughout their storage and distribution systems. The corrosion problem, for example with ethanol, is mainly due to the presence of a small amount, i.e., 3 to 9%, of water in the alcohol which is not removed during normal distillation processes. Although it is possible to remove this residual amount of water by a final distillation step, the cost is inordinately high. Accordingly, some processors do not normally remove the last amounts of water in the alcohol and the presence of such water enhances corrosion of metals with which the alcohol comes in contact. Further, impurities in the alcohol, such as chloride ions and acetic acid, also contribute to the corrosive effects of alcohol on metals it contacts during its transportation in the field and its use in the fuel systems of internal combustion engines.

Since alcohols come into contact with a variety of metals during their preparation, storage, distribution and transportation and within the fuel system of an internal combustion engine, corrosion scientists are faced with complex problems in the effort to inhibit corrosion in a system composed of various metals.

2. Prior Art

The most common metals encountered in the fuel systems of vehicles powered by internal combustion engines are alloys of zinc, copper, iron, tin, steel and aluminum. Most commonly, alloys such as ternplate, brass, steel and Zamak (an alloy of zinc, copper and aluminum) are encountered.

A variety of chemical corrosion inhibitors have been used to inhibit corrosion in metals such as zinc, steel, copper, etc. Such inhibitors include aliphatic and aromatic amines, amine salts of acids such as benzoic acid, hetercyclic amines such as pyridines, alkenyl succinic acids, triazoles such as benzotriazole and the like. Such inhibitors have been used in such media as salt water, acids and alkali. Other inhibitors which have been used include hydrogen sulfide, metal salts such as sodium chromate, sodium silicate, ferrous nitrate, ammonium phosphate, potassium dichromate, sodium borate, sodium phosphate, sodium nitrate, and sodium chlorate, glucose, borax, formamide, rosin amine, propargyl ether, propionic acid, valeric acid, quaternary amine salts, alkanolamines, aminophenols, alkyl and aryl mercaptans and the like. A comprehensive summary of corrosion inhibitors is set forth by M. Brooke, "Chemical Engineering", Feb. 5, 1982, pages 134 through 140 and by C. C. Nathan, *Corrosion Inhibitors,* (NACE), 1973.

SUMMARY OF THE INVENTION

In accordance with the present invention, it has been found that a particular combination of inhibitors greatly retards the corrosion of metals used in the fuel systems of vehicles which utilize alcohol as a fuel and retards corrosion of metals in the associated alcohol storage and distribution system. Thus, it has been found that a composition comprising an amine salt of an acid, together with a triazole, inhibits corrosion by alcohols. Accordingly, the present invention provides a composition for the inhibition of corrosion of metals by alcohols and the process of using same and a corrosion inhibited alcohol fuel.

DETAILED DESCRIPTION OF THE INVENTION

The corrosion inhibitor composition of the invention comprises (1) an amine salt of an acid and (2) a triazole.

Acids which are used to form salts with amines may be any acid which is capable of forming a salt with an amine. Examples of suitable acids include the saturated aliphatic monocarboxylic acids such as formic, acetic, propionic, butyric, caproic, caprylic, capric, lauric, myristic, palmitic, stearic and the like; saturated aliphatic dicarboxylic acids such as oxalic, malonic, succinic, glutaric, adipic, pimelic, suberic, azelaic, sebacic and the like, cycloaliphatic acids such as cyclohexane monocarboxylic acid and cyclohexane dicarboxylic acid; unsaturated aliphatic monocarboxylic acids such as acrylic, crotonic decenoic, decendioic, undecenoic, tridecenoic, pentadecenoic, pentadecendienoic, heptadeceneoic, oleic, linoleic, linolenic and the like; unsaturated aliphatic dicarboxylic acids such as fumaric and maleic; cyclic unsaturated carboxylic acids such as hydnocarpic and chaulmoorgric; aldehydic acids such as glyoxalic and ketonic acids such as pyruvic and acetoacetic; and aromatic acids such as benzoic, toluic, aminobenzoic, phenylacetic, naphthoic, phthalic, cinnamic, gallic and the like.

Preferred acids are the alkenyl dicarboxylic acids such as alkenylmalonic, alkenylsuccinic, alkenylglutaric, alkenyladipic, alkenylpimelic, alkenylsuberic, alkenylazelaic, alkenylsebacic and the like.

Especially preferred acids are the alkenylsuccinic acids and hydrolyzed alkenylsuccinic anhydrides. Exemplary alkenylsuccinic acids which may be used in accordance with the present invention are ethenylsuccinic, propenylsuccinic, tetrapropenylsuccinic, sulfurized-propenylsuccinic, butenylsuccinic, 2-methylbutenylsuccinic, 1,2-dichloropentenylsuccinic, hexenylsuccinic, 2,3-dimethylbutenylsuccinic, 3,3-dimethylbutenylsuccinic, 1,2-dibromo-2-ethylbutenylsuccinic, heptenylsuccinic, octenylsuccinic, 4-ethyhexenylsuccinic, nonenylsuccinic, decenylsuccinic, 1,2-dibromo-2-ethyloctenylsuccinic, undecenylsuccinic, dodecenylsuccinic, 2-propylnonenylsuccinic, tridecenylsuccinic, tetradecenylsuccinic, hexadecenylsuccinic, octadecenylsuccinic, eicosenylsuccinic, tetracosenylsuccinic, hexacosenylsuccinic, hentriacontenylsuccinic acid and the like.

The acids described hereinabove are well known and their various methods of preparation are also well known to those skilled in the art. For example, preparation of alkenylsuccinic acids is by the known reaction of an olefin with maleic acid. Alkenylsuccinic acids may be prepared as mixtures thereof by reacting a mixture of olefins with maleic acid. Such mixtures, as well as the pure acids, are utilizable herein.

Any acid, as exemplified by the above classes of acids, may be used herein to form a salt with an amine as one component of the corrosion inhibitor of the present invention. Accordingly, any acid may be used in accordance with the present invention so long as its salt with an amine is sufficiently soluble in alcohols to afford corrosion inhibition.

Similarly, any amine which will form an acid salt which is soluble in an alcohol and inhibits corrosion may be used in the present invention. Exemplary classes of amines which may be utilized herein include the primary, secondary and tertiary alkyl, aryl, alkaryl, aralkyl, alicylyl, and heterocyclyl amines and the like. Accordingly, typical amines include alkyl amines such as the mono-, di- and tri-alkylamines, e.g., methylamine, dimethylamine, trimethylamine, propylamine, tripropylamine, laurylamine, stearylamine, alkanolamines such as ethanolamine, triethanolamine; cyclohexylamines; phenylamines, morpholinylamines; pyridylamines; ethoxylated amines such as ethoxylated rosin amines; morpholines, pyridines; phenanthridines; amideimidazolines; rosin amines; fatty acid amines such as cocoanut fatty acid amines; alkylsulfonamides; alkylbenzensulfonamines; anilines; alkylenepolyamines, such as ethylenediamine; polyalkyleneimines such as polyethyleneimine and the like.

The above-described acids and amines are merely illustrative of the wide variety of acids and amines which may be used to form salts of the present invention. Obviously, one skilled in the art will readily determine other acids and amines which may be utilized in a functionally equivalent manner. The only limiting factors in determining the acid/amine salts which may be used herein is the solubility of the salt in alcohols, especially ethanol, and its corrosion inhibition characteristics. Determination of the appropriate amine salt to be used to afford corrosion inhibition of a particular metal may require a modicum of experimentation which is well within the scope of one skilled in the art. More than one acid/amine salt may be present in the composition of the invention.

The second component of the corrosion inhibitor of the invention is a triazole. Suitable triazoles which may be used in the present invention include substituted triazoles such as heterocyclic, aromatic and sulfur-substituted triazoles such as pyrrodiazole, benzotriazole, diphenyltriazole, tolyltriazole, mercaptobenzotriazole and similar triazoles.

The corrosion inhibitor is normally added to the alcohol at bulk storage facilities, usually in the form of a solution of the inhibitor in an appropriate solvent such as trimethylbenzene, isopropanol or other carrier for ease of handling and treating.

The acid/amine salt is prepared, in general, as follows:

The acid and amine numbers are determined for each of the reactants and combined in the correct proportions depending on the product desired. The reaction is exothermic and cooling may be desired. There is no water of reaction formed.

The ratio of amine to acid, based on amine and acid number determinations, is generally from about 1:0.5 to about 1:2, preferably from about 1:0.75 to about 1:1.25, especially about 1:1.05.

The ratio, on a weight basis, of the salt component to the triazole component is generally from about 5:1 to about 140:1, preferably from about 20:1 to about 100:1, especially about 70:1.

The inhibitor is normally added to alcohol in a minor but effective corrosion inhibiting amount. Generally, the concentration of inhibitor in alcohol is from about 0.001 to about 1.00%, preferably from about 0.03 to about 0.50%, especially about 0.25% on a volume basis.

In the following illustrative examples, a corrosion test was used to measure the corrosion effects of hydrated ethanol on coupled, dissimilar metals. The corrosion test is specified in paragraph 3.31 on "Anti-corrosive Additive for Hydrated Ethylalcohols" Volkswagen do Brasil, SA Provisory Norm CT VW 580 83 BR.

SUMMARY

A set of metal coupons (Zamak, brass and steel) is immersed in hydrated ethanol for 6 days at 50° C. At the end of 6 days the coupons are visually inspected and weight changes are recorded.

DESCRIPTION OF TEST CONDITIONS

A coupon set consists of one Zamak, one brass, and one steel coupon, each having a 5 mm diameter centered hole. The coupons set is assembled on a 4 mm diameter threaded brass stud with a 1 mm thick brass washer placed between the Zamak and brass coupons, the brass coupon in direct contact with the steel coupon and brass nuts isolated from the coupons with Teflon washers.

The coupon dimension and compositions are listed below:

| | | |
|---|---|---|
| Zamak coupon | 40 × 20 × 3 mm | DIN-1743 |
| Brass coupon | 23 × 15 × 2.5 mm | DIN-17660 (ABNT P-TB-50) |
| Steel coupon | 24 × 10 × 2 mm | DIN-1651 (ABNT 12L 14) |
| Brass washer | 1 mm thick, 12 mm diameter | DIN-17660 (ABNT P-TB-50) |

PROCEDURE

A. The plane faces of the coupons, brass washer, and nuts are prepared by wet polishing with No. 320 aluminum oxide polishing paper. The Zamak and brass coupons are wet polished with water while the steel coupon is polished using anhydrous ethanol.

B. After polishing the coupons, washers and nuts are cleaned with a soft brush under tap water, rinsed in anhydrous ethanol and then rinsed in acetone. The coupons are stored in a desiccator under vaccum for 45 minutes and then weighed to the nearest 0.1 mg.

C. The coupon unit is assembled as described above using gloves and taking care not to touch the parts with bare hands. One hundred fifty (150) milliliters of hydrated ethanol are measured into a 250 ml wide-mouth Erlenmeyer flask. The coupon assembly is placed in the alcohol so that the stud is at a 45° angle to the horizontal. The flask is closed with polyethylene film. The flask is placed in an oven maintained at 50° C. for six days.

D. At the end of the six day test period, the samples are removed from the oven and allowed to cool. The coupon set is then removed and disassembled. The three coupons are cleaned, dried and weighed as in Paragraph B above. Weight changes are determined and visual observations recorded.

EXAMPLES 1 THROUGH 3

In these examples, Zamak, brass and steel coupons were tested in the static corrosion test, described above, singly and coupled in a unit. The results are shown in Table I.

TABLE I

STATIC CORROSION TEST
Procedure using Brazilian Ethanol

| EX. | COUPON TYPE* | ADDITIVE | VISUAL OBSERVATIONS @ 6 DAYS | WEIGHT CHANGE (mg.) |
|---|---|---|---|---|
| 1A | Zamak 5 | No add. | slight corrosion; a few gray spots on surface | +0.1 |
| 1B | Brass | No add. | discolored; dark gray in color | −0.2 |
| 2 | Steel | No add. | small rust spots over much of surface | −0.5 |
| 3 | All coupons coupled as a unit | No add. | very heavy corrosion - Zamak 5 | −5.4 |
| | | | slight discoloration - brass | +0.3 |
| | | | a few small rust spots - steel | −0.2 |

*Zamak 5 - Zinc alloy $ZN_{95}AL_4CU_1$
Brass - Cartridge brass (70 Cu/30 Zn)
Steel - Mild, 1010 carbon steel The data indicate severe corrosion of Zamak alloy and only slight corrosion of other metals when coupled as a unit. Only slight corrosion is evident on uncoupled coupons.

EXAMPLES 4 THROUGH 7

In these examples, a coupon of cartridge brass was tested in the static corrosion test and the results, comparing the use of benzotriazole to a control are shown in Table II.

TABLE II

STATIC CORROSION TEST
PROCEDURE USING BRAZILIAN ETHANOL*
Metal Coupon: Cartridge brass (70 Cu/30 Zn)

| EX | ADDITIVE | CONC. (ppm) | VISUAL OBSERVATIONS 2 days | VISUAL OBSERVATIONS 6 days |
|---|---|---|---|---|
| 4 | No additive | — | very tarnished & discolored | discolored & corrode |
| 5 | Composition A (Benzotriazole) | 10 | one edge tarnished-otherwise bright | ≈25% of surface slightly tarnished |
| 6 | Composition A (Benzotriazole) | 50 | bright and shiny | bright and shiny |
| 7 | Composition A (Benzotriazole) | 100 | bright and shiny | bright and shiny |

*Ethanol adjusted for water and acetic acid content

The data indicate that the benzotriazole, used alone, is effective in controlling corrosion of brass in the ethanol test fuel.

EXAMPLES 8 AND 9

In these examples, static corrosion tests were performed on coupled Zamak, brass and steel coupons showing the results of using an inhibitor system consisting of the salt of an amideimidazoline with tetrapropenylsuccinic acid and benzotrizole. The results are shown in Table III.

TABLE III

Procedure using Brazilian Ethanol

| EX | ADDITIVE | CONC. (ppm) | COUPON TYPE | VISUAL OBSERVATION @ 6 DAYS | WEIGHT CHANGES (mg) |
|---|---|---|---|---|---|
| 8 | Composition B (Benzotriazole TPSA/Amideimidazoline Salt) | 500 | Zamak 5* | slight corrosion on top; bottom clean | −0.7 |
| | | | Brass | slight discloration | +0.2 |
| | | | Steel | slight rusting on bottom surface | −0.8 |
| 9 | Composition B (Benzotriazole TPSA/Amideimidazoline Salt) | 1000 | Zamak 5* | same appearance for each type of coupon as at 500 ppm rate | −0.7 |
| | | | Brass | | +0.1 |
| | | | Steel | | −0.6 |

{}* coupons coupled on glass rod
TPSA = tetrapropenylsuccinic acid

The data indicate that a composition comprising benzotriazole and the salt of amideimidazoline with tetrapropenylsuccinic acid is effective in controlling corrosion of the Zamak alloy when compared to the results of Table I.

EXAMPLES 10 THROUGH 23

In these examples, coupled Zamak, brass and steel coupons were static corrosion tested using various inhibitor systems as compared to a control. The results are shown in Table IV.

TABLE IV

STATIC CORROSION TEST
Volkswagon Test Procedure
Using Brazilian Ethanol
Metal coupons coupled with brass rod, washers, and nuts. Complete assembly tested as a unit.

| EX | ADDITIVE | TPSA* | n-DDSA** | AMIDEIMID-AZOLINE | n-DECYLAMINE | *** t-ALKYLAMINES | COCOAMINE | AMINE SALT± |
|---|---|---|---|---|---|---|---|---|
| 10 | none | — | — | — | — | — | — | — |
| 11 | Comp. A | X | — | X | — | — | — | — |
| 12 | Comp. B | X | — | X | — | — | — | — |
| 13 | Comp. C | X | — | X | — | — | — | — |
| 14 | Comp. D | X | — | X | — | — | — | — |
| 15 | Comp. E | X | — | X | — | — | — | — |
| 16 | Comp. F | X | — | X | — | — | — | — |
| 17 | Comp. G | — | X | X | — | — | — | — |
| 18 | Comp. H | X | — | X | — | — | — | — |
| 19 | Comp. I | — | X | — | — | X | — | — |
| 20 | Comp. J | X | — | — | X | — | — | — |
| 21 | Comp. K | X | — | — | — | X | — | — |
| 22 | Comp. L | X | — | — | — | — | X | — |
| 23 | Comp. M | — | — | X | — | — | — | X |

| EX | ADDITIVE | BENZOTRIAZOLE | TOLYL-TRIAZOLE | ADDITIVE TREATING RATE (ppm) | APPROXIMATE RATIO OF SALT:TRIAZOLE | COUPON WT. CHANGE (mg.) STEEL | BRASS | ZAMAK 5 |
|---|---|---|---|---|---|---|---|---|
| 10 | none | — | — | — | — | +0.1 | +0.6 | −8.3 |
| 11 | Comp. A | — | X | 540 | 17:1 | +0.3, 0 | −0.8, +0.2 | −1.5, −1.6 |
| 12 | Comp. B | — | X | 560 | 10:1 | 0 | +0.5 | −1.9 |
| 13 | Comp. C | — | X | 610 | 5:1 | 0 | +0.3 | −3.4 |
| 14 | Comp. D | — | X | 1030 | 102:1 | −0.3 | +0.1 | −2.1 |
| 15 | Comp. E | — | X | 1300 | 51:1 | −0.1 | +0.2 | −1.8 |
| 16 | Comp. F | — | X | 1350 | 17:1 | 0 | +0.3 | −2.0 |
| 17 | Comp. G | — | X | 1210 | 120:1 | 0 | +0.2 | −3.2 |
| 18 | Comp. H | X | — | 610 | 5:1 | −0.1 | +0.4 | −2.5 |
| 19 | Comp. I | — | X | 700 | 6:1 | −0.2 | +0.2 | −2.4 |
| 20 | Comp. J | — | X | 240 | 7:1 | −0.2 | −0.1 | −2.7 |
| 21 | Comp. K | — | X | 443 | 17:1 | −0.2 | 0 | −1.3 |
| 22 | Comp. L | — | X | 456 | 17:1 | −0.1 | +0.2 | −2.1 |
| 23 | Comp. M | — | X | 625 | 24:1 | 0 | +0.7 | −2.1 |

*Tetrapropenylsuccinic acid
**n-Dodecenylsuccinic acid
***Mixture of t-alkylamines
±Tetrapropenyl succinic acid/alkanolamine reaction product The data indicate that mixtures of acid/amine salts and a triazole are effective in reducing the corrosive effects of ethanol test fuel on various metal alloys.

EXAMPLES 24 THROUGH 29

In these examples, Zamak, brass and steel coupons were coupled and static corrosion tested with various inhibitor systems. The results are shown in Table V.

TABLE V

STATIC CORROSION TEST
Fuel: Ethyl Alcohol obtained from Brazil with alcohol content reduced to 92.6% and acetic acid content raised to 3.0 mg/100 ml

| EX | ADDITIVE | COMPONENTS TPSA | t-ALKYLAMINE | TOLYLTRIAZOLE | TREATING RATE (ppm) VOL/VOL* 1000 | 2500 | APPROX. RATIO SALT:TRIAZOLE |
|---|---|---|---|---|---|---|---|
| 24 | None | — | — | — | — | — | — |
| 25 | Comp. N | X | X | X | X | — | 17:1 |
| 26 | Comp. O | X | X | X | — | X | 42:1 |
| 27 | Comp. P | X | X | X | — | X | 69:1 |
| 28 | Comp. Q | X | X | X | — | X | 71:1 |
| 29 | Comp. R | X | X | X | — | X | 67:1 |

| EX | ADDITIVE | COUPON TYPE | WT. Δ in mg. | WT. Δ in g/m² | AVERAGE Wt. Δ in g/m² |
|---|---|---|---|---|---|
| 24 | None | Zamak 5 | −6.6, −6.8, −6.9 | −3.17, −3.27, 3.3 | −3.25 |
| | | Brass | +0.3, +0.2, +0.2 | +0.33, +0.22, +0.22 | +0.26 |
| | | Steel | −0.2, 0, 0 | −0.34, 0, 0 | −0.11 |
| 25 | Comp. N | Zamak 5 | −2.2, −2.5, −2.6 | −1.06, −1.20, −1.25 | −1.17 |
| | | Brass | +0.3, +0.3, +0.2 | +0.33, +0.33, +0.22 | +0.29 |
| | | Steel | 0, 0, 0 | 0, 0, 0 | 0.00 |
| 26 | Comp. O | Zamak 5 | −1.4, −1.7, −1.2 | −0.67, −0.82, −0.58 | −0.69 |
| | | Brass | +0.1, 0, 0 | +0.11, 0, 0 | +0.04 |
| | | Steel | 0, −0.1, 0 | 0, −0.17, 0 | −0.06 |
| 27 | Comp. P | Zamak 5 | −0.9, −0.9, −1.1 | −0.43, −0.43, −0.53 | −0.46 |
| | | Brass | 0, +0.1, +0.1 | 0, +0.12, +0.12 | +0.08 |
| | | Steel | 0, +0.1, −0.1 | 0, +0.17, −0.17 | 0.00 |
| 28 | Comp. Q | Zamak 5 | −0.8 | −0.38 | — |

TABLE V-continued

| STATIC CORROSION TEST Fuel: Ethyl Alcohol obtained from Brazil with alcohol content reduced to 92.6% and acetic acid content raised to 3.0 mg/100 ml | | | | | |
|---|---|---|---|---|---|
| | | Brass | +0.2 | +0.22 | — |
| | | Steel | +0.1 | +0.17 | — |
| 29 | Comp. R | Zamak | −0.9 | −0.43 | — |
| | | Brass | +0.1 | +0.11 | — |
| | | Steel | +0.1 | +0.17 | — |

*Added volumetrically

EXAMPLE 30

In addition to static corrosion tests, an electrochemical technique was used to measure the corrosion rate of Brazilian hydrated ethanol on mild steel (1018) in the presence and absence of the corrosion inhibitor composition of the present invention. The electrochemical technique used was the Polarization Admittance Instantaneous Rate (PAIR) technique. In this example, the test fluid was Brazilian hydrated ethanol with water and acetic acid content adjusted to 7.4% and 30 ppm, respectively.

The procedure involved placing mild steel elctrodes (connected to a Petrolite Instruments Model M-1010 PAIR brand polarization rate meter) in a 1000 ml tall-form beaker containing 900 ml of the test fluid. The alcohol was stirred, open to the atmosphere, at ambient temperature for the test duration (i.e., 18 hours). The results are shown in Table VI. The Table reports the corrosion rate in MPY (mils/yr) which are average of the anodic and cathodic readings for the test fuel. The higher corrosion rate measured initially in the sample containing additive is due to the increased conductivity of the alcohol due to the presence of the acid/amine salt. The calculated percent protection at 18 hours is 88%.

TABLE VI

| ELAPSED TIME, HOURS | CORROSION RATE, MPY | |
|---|---|---|
| | NO ADDITIVE ADDED | COMPOSITION EXAMPLE NO. 29 ADDED AT 2500 ppm |
| 1 | 0.104 | 0.175 |
| 2 | 0.106 | 0.112 |
| 3 | — | 0.078 |
| 4 | — | 0.060 |
| 5 | — | 0.048 |
| 6 | — | 0.040 |
| 18 | 0.110 | 0.013 |

While the illustrative embodiments of the invention have been described with particularity, it will be understood that various other modifications will be apparent to and can be readily made by those skilled in the art without departing from the spirit and scope of the invention.

Accordingly, it is not intended that the scope of the claims appended hereto be limited to the examples and description set forth herein, but rather than the claims be construed as encompassing all the features of patentable novelty which reside in the present invention, including all features which would be treated as equivalents thereof by those skill in the art to which the invention pertains.

We claim:

1. Corrosion inhibitor Composition consisting essentially of a mixture of a triazole and at least one amine salt of an acid.

2. Composition of claim 1 wherein said triazole is benzotriazole.

3. Composition of claim 1 wherein said triazole is tolyltriazole.

4. Composition of claim 1 wherein said amine is an amideimidazoline.

5. Composition of claim 1 wherein said amine is a t-alkylamine.

6. Composition of claim 1 wherein said amine is an alkanolamine.

7. Composition of claim 1 wherein said acid is an alkenylsuccinic acid.

8. Composition of claim 7 wherein said acid is tetrapropenylsuccinic acid.

9. Composition of claim 7 wherein said acid is dodecenylsuccinic acid.

10. Corrosion inhibiting fuel comprising a hydrated alcohol and an effective corrosion inhibiting amount of a composition of claim 1.

11. Method of inhibiting corrosion of metals by hydrated alcohol comprising adding to said alcohol an effective corrosion inhibiting amount of a composition of claim 1.

12. Composition consisting essentially of a mixture of a triazole and an amine salt of an alkenylsuccinic acid.

13. Composition of claim 12 wherein said triazole is benzotriazole.

14. Composition of claim 12 wherein said triazole is tolyltriazole.

15. Composition of claim 12 wherein said amine is an amideimideazoline.

16. Composition of claim 12 wherein said amine is a t-alkylamine.

17. Composition of claim 12 wherein said amine is an alkanolamine.

18. Composition of claim 12 wherein said acid is tetrapropenylsuccinic acid.

19. Composition of claim 12 wherein said acid is dodecenylsuccinic acid.

20. Corrosion inhibited fuel comprising a hydrated alcohol and an effective corrosion inhibiting amount of a composition of claim 12.

21. Method of inhibiting corrosion of metals by hydrated alcohol comprising adding to said alcohol an effective corrosion inhibiting amount of a composition of claim 12.

22. Method of inhibiting corrosion of metals by fuels containing a hydrated alcohol comprising adding to said fuel an effective corrosion inhibiting amount of a composition of claim 1.

23. Method of inhibiting corrosion of metals by fuels containing a hydrated alcohol comprising adding to said fuel an effective corrosion inhibiting amount of a composition of claim 12.

* * * * *